US009410520B2

(12) United States Patent
Franks et al.

(10) Patent No.: US 9,410,520 B2
(45) Date of Patent: Aug. 9, 2016

(54) INTERNAL COMBUSTION ENGINE INCLUDING AN INJECTOR COMBUSTION SEAL POSITIONED BETWEEN A FUEL INJECTOR AND AN ENGINE BODY

(71) Applicant: CUMMINS INC., Columbus, IN (US)

(72) Inventors: Gregory S. Franks, Edinburgh, IN (US); Joshua G. Knight, Columbus, IN (US); Fred M. Rasener, Columbus, IN (US); Hanna C. Small, Columbus, IN (US); Eric L. Stacy, Columbus, IN (US); Joseph A. Worthington, Greenwood, IN (US); Amit Yeole, Columbus, IN (US)

(73) Assignee: Cummins Inc., Columbus, IN (US)

( * ) Notice: Subject to any disclaimer, the term of this patent is extended or adjusted under 35 U.S.C. 154(b) by 253 days.

(21) Appl. No.: 13/962,641

(22) Filed: Aug. 8, 2013

(65) Prior Publication Data

US 2015/0040857 A1 Feb. 12, 2015

(51) Int. Cl.

| | |
|---|---|
| ***F02B 3/00*** | (2006.01) |
| ***F02M 53/06*** | (2006.01) |
| ***F02M 53/04*** | (2006.01) |
| ***F02M 61/14*** | (2006.01) |

(52) U.S. Cl.

CPC ..... *F02M 61/14* (2013.01); *F02M 2200/858* (2013.01)

(58) Field of Classification Search

CPC ..... F02M 53/06; F02M 53/04; F02M 2200/9038; F02M 2200/858

See application file for complete search history.

(56) References Cited

U.S. PATENT DOCUMENTS

| | | | | | |
|---|---|---|---|---|---|
| 3,841,277 | A | * | 10/1974 | Schafer | 123/470 |
| 3,868,939 | A | * | 3/1975 | Friese et al. | 123/179.15 |
| 3,945,353 | A | * | 3/1976 | Dreisin | 123/41.22 |
| 4,296,887 | A | * | 10/1981 | Hofmann | F02M 61/14 123/271 |
| 4,609,150 | A | | 9/1986 | Pane, Jr. et al. | |
| 4,620,516 | A | | 11/1986 | Reüm et al. | |
| 5,345,913 | A | * | 9/1994 | Belshaw et al. | 123/470 |
| 5,361,990 | A | * | 11/1994 | Pimentel | 239/133 |
| 5,785,024 | A | * | 7/1998 | Takei | F02F 11/00 123/470 |

(Continued)

FOREIGN PATENT DOCUMENTS

| | | | |
|---|---|---|---|
| DE | 35 29 769 | A1 | 2/1987 |
| DE | 3529769 | A1 | 2/1987 |

(Continued)

OTHER PUBLICATIONS

International Search Report and Written Opinion dated Nov. 13, 2014 in corresponding International Application No. PCT/US2014/047589.

*Primary Examiner* — Marguerite McMahon
*Assistant Examiner* — Tea Holbrook
(74) *Attorney, Agent, or Firm* — Faegre Baker Daniels LLP

(57) ABSTRACT

This disclosure provides a fuel injector seal assembly comprising a seal component fabricated or formed of a first material and a thermally conductive or heat transfer component fabricated or formed of a second material that is different from the first material. The first material has a greater strength than the second material, and the second material has a greater thermal conductivity than the first material. Thus, the injector seal assembly is able to provide a primary benefit of a combustion seal while also providing an enhanced benefit of transferring heat from one portion of the fuel injector to another portion of the fuel injector.

19 Claims, 3 Drawing Sheets

(56) References Cited

U.S. PATENT DOCUMENTS

| | | | | |
|---|---|---|---|---|
| 6,073,938 | A * | 6/2000 | Abe et al. | 277/654 |
| 6,076,356 | A | 6/2000 | Pelletier | |
| 6,155,236 | A * | 12/2000 | Jehle et al. | 123/470 |
| 6,182,437 | B1 | 2/2001 | Prociw | |
| 6,460,512 | B1 * | 10/2002 | Serio | F16J 15/0806 123/470 |
| 6,481,421 | B1 * | 11/2002 | Reiter | 123/470 |
| 6,512,204 | B1 * | 1/2003 | Chiu et al. | 219/270 |
| 6,892,707 | B2 * | 5/2005 | Reiter | F02M 61/14 123/470 |
| 7,028,918 | B2 | 4/2006 | Buchanan et al. | |
| 7,325,402 | B2 | 2/2008 | Parker et al. | |
| 7,331,535 | B2 * | 2/2008 | Lambert et al. | 239/132 |
| 7,513,242 | B2 | 4/2009 | Morris | |
| 7,559,312 | B2 * | 7/2009 | Brauneis et al. | 123/470 |
| 7,832,376 | B2 * | 11/2010 | Mueller et al. | 123/470 |
| 7,832,377 | B2 | 11/2010 | Lee et al. | |
| 7,918,209 | B2 * | 4/2011 | Fischetti et al. | 123/470 |
| 8,015,816 | B2 | 9/2011 | Hall | |
| 8,230,838 | B2 | 7/2012 | Clark et al. | |
| 8,978,624 | B2 * | 3/2015 | Kamada et al. | 123/470 |
| 2003/0155432 | A1 * | 8/2003 | Buchanan et al. | 239/132.3 |
| 2003/0155446 | A1 * | 8/2003 | Reiter | 239/585.1 |
| 2004/0060544 | A1 * | 4/2004 | Reiter et al. | 123/470 |
| 2004/0080115 | A1 * | 4/2004 | Tsuchiya et al. | 277/458 |
| 2006/0157034 | A1 * | 7/2006 | Gottlieb et al. | 123/470 |
| 2007/0251503 | A1 * | 11/2007 | Buehner | 123/470 |
| 2008/0246228 | A1 * | 10/2008 | Hanneke et al. | 277/595 |
| 2008/0271713 | A1 * | 11/2008 | Morris | 123/470 |
| 2008/0295806 | A1 * | 12/2008 | Chang et al. | 123/470 |
| 2009/0294552 | A1 * | 12/2009 | Trapasso et al. | 239/132 |
| 2011/0067653 | A1 * | 3/2011 | Clark et al. | 123/41.31 |
| 2011/0132329 | A1 * | 6/2011 | Hofmann et al. | 123/470 |
| 2011/0272495 | A1 * | 11/2011 | Nunic et al. | 239/533.2 |
| 2012/0037124 | A1 * | 2/2012 | Peters et al. | 123/470 |

FOREIGN PATENT DOCUMENTS

| | | | |
|---|---|---|---|
| EP | 0440674 | B1 | 8/1991 |
| EP | 0 440 674 | B1 | 6/1992 |
| RU | 2 105 186 | C1 | 2/1998 |
| RU | 2105186 | C1 | 2/1998 |

* cited by examiner

INTERNAL COMBUSTION ENGINE INCLUDING AN INJECTOR COMBUSTION SEAL POSITIONED BETWEEN A FUEL INJECTOR AND AN ENGINE BODY

TECHNICAL FIELD

This disclosure relates to fuel injector seal assemblies for internal combustion engines.

BACKGROUND

An internal combustion engine with a fuel injector may require a combustion seal to keep combustion gases in a combustion chamber of the internal combustion engine from flowing into a passage surrounding the fuel injector. One challenge with such seals is that they may be inefficient in transporting or transferring heat away from a nozzle housing of the fuel injector, or if such seals transport heat away from a distal end of a nozzle element housing, the seals may have insufficient strength to resist yielding, which may ultimately permit leaks.

SUMMARY

This disclosure provides an internal combustion engine including a fuel injector assembly for mounting in an engine cylinder head, comprising an engine cylinder head sealing surface, a fuel injector body, and an injector seal assembly. The fuel injector body includes a longitudinal axis, a nozzle element housing, and a nozzle retainer. The injector seal assembly is positioned between the fuel injector body and the engine cylinder head, and the injector seal assembly includes a seal component formed of a first material, the seal component positioned in a space formed longitudinally between the fuel injector body and the engine cylinder head sealing surface for receiving a fuel injector clamp force, and a thermally conductive component formed of a second material different than the first material, the second material having a higher thermal conductivity than the first material, and the thermally conductive component positioned radially between the nozzle element housing and the seal component to transfer heat from the nozzle element housing to the seal component.

This disclosure also provides an internal combustion engine, comprising a mounting bore, a fuel injector positioned in the mounting bore, and an injector seal assembly. The mounting bore has a longitudinal axis formed in a portion of the engine and includes a sealing surface formed at a first angle with respect to the longitudinal axis. The fuel injector is positioned in the mounting bore and the fuel injector includes an injector body having a nozzle housing. The injector seal assembly includes a sealing ring and a heat transfer sleeve. The sealing ring is positioned longitudinally between the injector body and the sealing surface to create a first fluid seal between the sealing ring and the sealing surface. The heat transfer sleeve includes a heat transfer sleeve first end, a heat transfer sleeve second end, a heat transfer sleeve inner surface, and a heat transfer sleeve outer surface. The heat transfer sleeve is sized and dimensioned to be positionable in the mounting bore adjacent the nozzle housing. The heat transfer sleeve inner surface is dimensioned to exert a radial force inwardly on the nozzle housing at the heat transfer sleeve second end and the heat transfer sleeve outer surface is dimensioned to exert a radial force outwardly on the sealing ring at the heat transfer sleeve first end.

This disclosure also provides an internal combustion engine comprising an engine body, a fuel injector, a spacer component, and a thermally conductive component. The engine body includes a combustion chamber and a mounting bore. The fuel injector is positioned in the mounting bore and includes a longitudinal axis and a distal end. The spacer component is positioned longitudinally between the fuel injector and the engine body at a spaced longitudinal distance from the distal end. The thermally conductive component is in contact with the distal end and with the spacer component and is positioned a spaced radial distance from the engine body and a spaced radial distance from the fuel injector in a region extending between the distal end and the spacer component.

Advantages and features of the embodiments of this disclosure will become more apparent from the following detailed description of exemplary embodiments when viewed in conjunction with the accompanying drawings.

DETAILED DESCRIPTION

Figure 1:
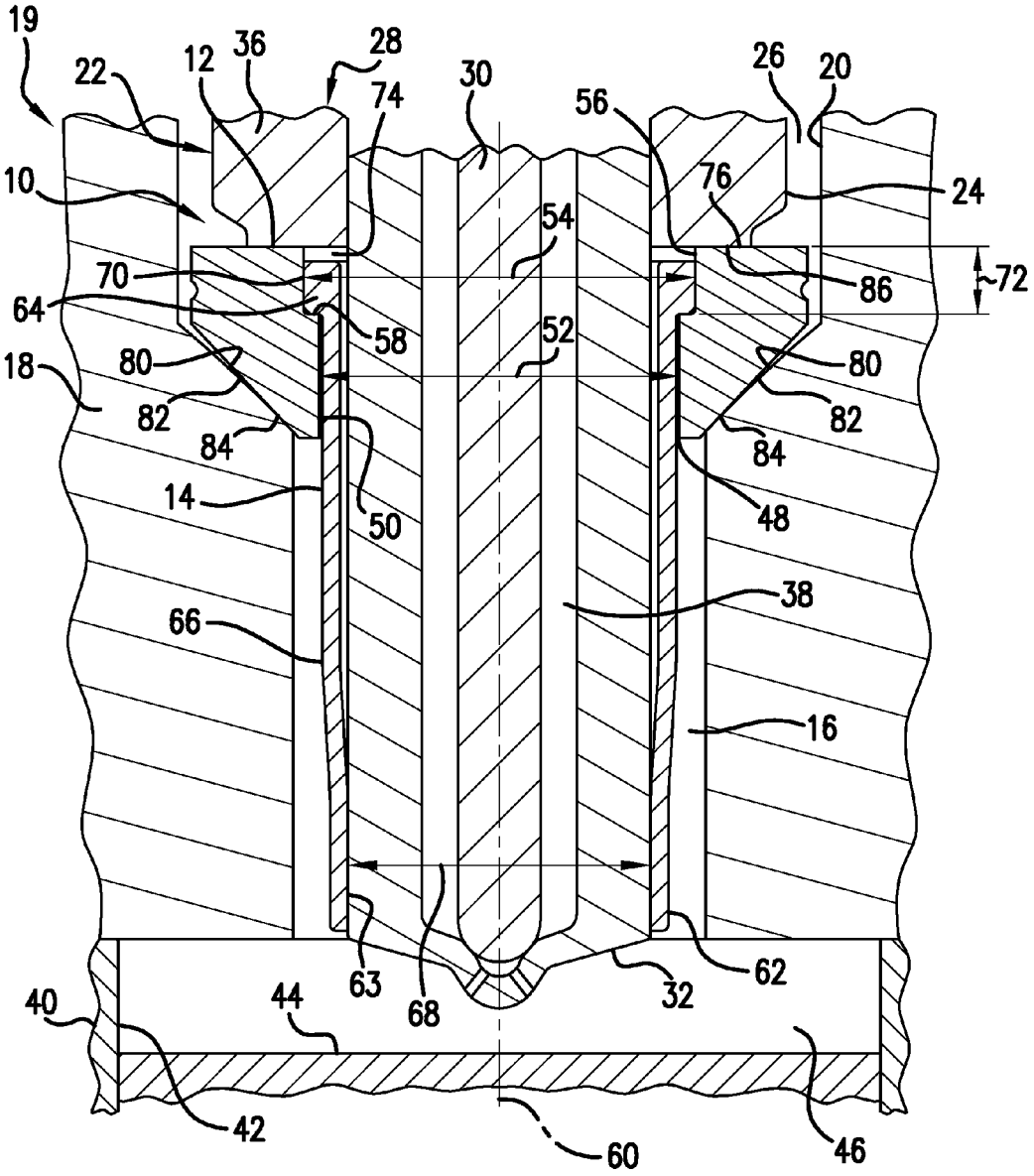
FIG. 1 is a cross-sectional view of an injector seal assembly in accordance with a first exemplary embodiment of the present disclosure inserted into position in an engine mounting bore.
Figure 2:
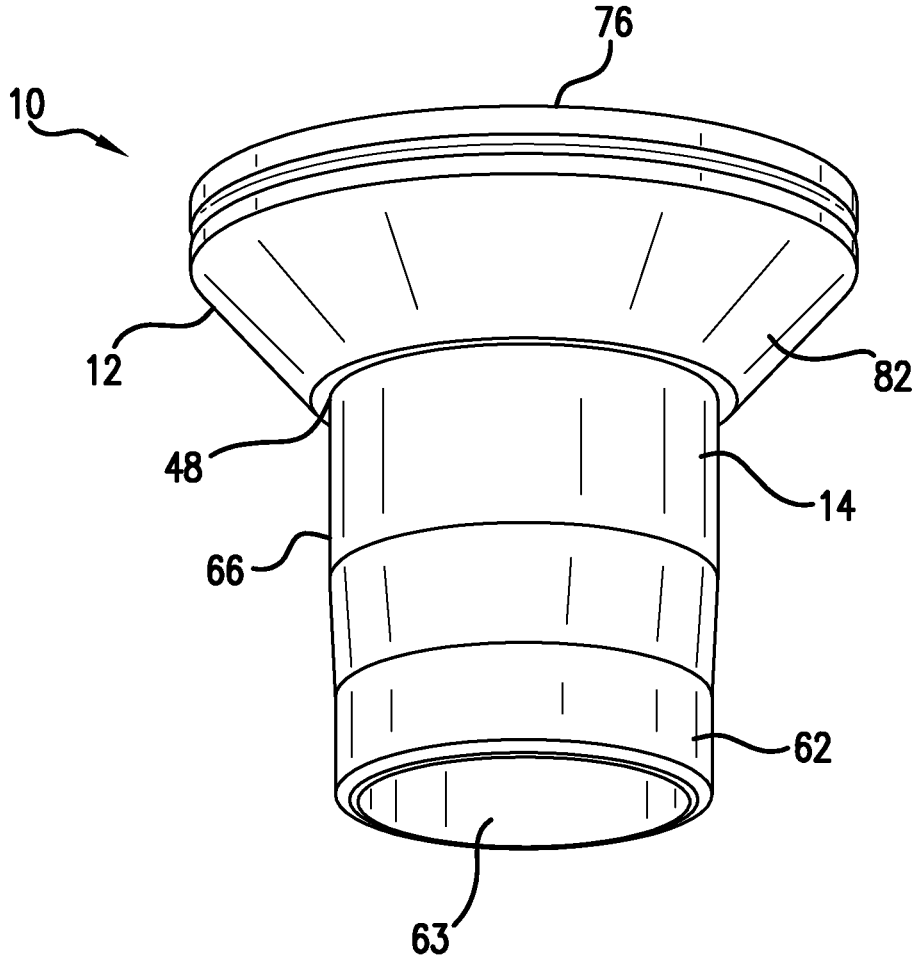
FIG. 2 is a perspective view of the injector seal assembly of FIG. 1.

An exemplary embodiment of an injector seal assembly, generally indicated at 10 in FIGS. 1 and 2, includes a seal component, sealing ring, or spacer component 12 formed of a first material, and a heat transfer sleeve, heat transfer inner sleeve, or thermally conductive component 14 that is formed of a second material that is different from the first material, for positioning in a fuel injector mounting bore 16 formed in a portion, e.g., cylinder head 18, of an engine body 19 of an internal combustion engine. While sealing ring 12 and thermally conductive component 14 are formed as distinct or separate components, in the exemplary embodiment they are connected to each other to form injector seal assembly 10, described in more detail hereinbelow. Cylinder head 18 includes an interior surface 20 that forms fuel injector mounting bore 16. The internal combustion engine also includes a fuel injector 22, which includes a peripheral exterior surface 24, positioned in fuel injector mounting bore 16. Interior surface 20 of fuel injector mounting bore 16 and exterior surface 24 of fuel injector 22 forms an annular gap or passage 26 that extends radially between fuel injector 22 and cylinder head 18. Engine body 19, which includes cylinder head 18, also includes an engine block 40 to which cylinder head 18 is attached. Engine block 40 includes one or more cylinders 42, and a piston 44 positioned for reciprocal movement in each cylinder 42. During longitudinal movement of piston 44 toward fuel injector 22, fuel injector 22 injects fuel into a combustion chamber 46 formed by the portion of cylinder 42 that extends from piston 44 to cylinder head 18.

The process of combustion needs to be separated from annular gap or passage 26 or damage to fuel injector 22, cylinder head 18, and other components of the internal combustion engine can occur. While it is known to position a seal between a fuel injector and a cylinder head, such seals have an array of challenges. For example, the seal must be able to carry a fuel injector clamp load to maintain structural integrity when clamped between fuel injector 22 and cylinder head 18. While injector seal assembly 10 achieves the core benefit of combustion sealing, it beneficially combines combustion sealing with an enhanced ability to conduct, transfer, or wick heat away from the distal end of fuel injector 22 to maintain the reliability of fuel injector 22. Injector seal assembly 10 addresses these challenges by fabricating sealing ring 12 of a metal able to withstand the fuel injector clamp loads transmitted through fuel injector 22 into sealing ring 12 and then into cylinder head 18, and by fabricating separate heat transfer sleeve 14 of a metal having a higher thermal conductivity than the material of sealing ring 12. Additionally, the contact between sealing ring 12, heat transfer sleeve 14, fuel injector 22, and cylinder head 18 is optimized to transfer heat from the distal end of fuel injector 22 upwardly to a cooler portion of fuel injector 22, providing a thermal path for heat from the distal end of fuel injector 22.

Throughout this specification, inwardly, distal, and near are longitudinally in the direction of combustion chamber 46. Outwardly, proximate, and far are longitudinally away from the direction of combustion chamber 46.

Fuel injector 22 includes a plurality of components, including an injector body 28 in which is positioned a needle or nozzle valve element 30. Fuel injector 22 includes other elements, including an actuator (not shown). Injector body 28 includes a nozzle element housing 32 and a housing retainer 36 that attaches nozzle element housing 32 to fuel injector 22. Injector body 28 also includes a nozzle element cavity 38 in which nozzle valve element 30 is positioned for reciprocal movement along a fuel injector longitudinal axis 60. Nozzle element housing 32 includes a nozzle housing diameter.

Annular gap or passage 26 is simply, easily and reliably sealed from combustion chamber 46 to isolate annular gap or passage 26 from combustion chamber 46 by insertion of injector seal assembly 10 between fuel injector 22 and a portion of the internal combustion engine, e.g., cylinder head 18. More specifically, sealing ring 12 is positioned longitudinally between injector body 28 and a sealing surface formed in fuel injector mounting bore 16. Injector seal assembly 10 provides a metal to metal combustion seal with contact pressures high enough to yield sealing ring 12 into sealing contact against interior surface 20 of injector mounting bore 16, and then maintain that contact pressure with the force from the fuel injector 22 mounting or securement system (not shown). That is, the injector clamping or securing load, for securing fuel injector 22 in mounting bore 16, is relied upon to apply a sealing force to sealing ring 12. In an exemplary embodiment, injector mounting bore 16 includes a sealing surface 80 positioned at an angle to longitudinal axis 60, thus providing a conical sealing surface, and sealing ring 12 includes sealing ring angled surface 82 that contacts bore angled surface 80 when sealing ring 12 is positioned longitudinally between injector body 28 and sealing surface 80 in injector mounting bore 16. The contact between sealing ring angled surface 82 and sealing surface 80 forms a fluid seal. In an exemplary embodiment, bore angled surface 80 is at a full angle of about 90 degrees, and sealing ring angled surface 82 is at a full angle of about 87.25 degrees, which is an angle of about 43.625 degrees with respect to longitudinal axis 60. The clamp load that holds fuel injector 22 in injection mounting bore 16 transfers load through a load path that includes an annular line of contact 84 between bore angled surface 80 and sealing ring angled surface 82, forming a fluid seal between sealing ring 12 and engine body 19.

In addition to forming a fluid seal between sealing ring 12 and engine body 19, sealing ring 12 forms a fluid seal with injector body 28. More specifically, sealing ring 12 includes a sealing ring proximate end surface 76 and injector body 28 includes an injector body surface 86, and the clamp load that forms a fluid seal between sealing ring 12 and engine body 19 also forms a load path through sealing ring proximate end surface 76 and injector body surface 86 to create a fluid seal between sealing ring proximate end surface 76 and injector body surface 86.

Sealing ring 12 is sized, dimensioned, and formed of an appropriate material such that sealing ring 12 retains its structural integrity under the clamp load from the fuel injector 22 mounting or securement system. Sealing ring 12 is generally circular in shape and includes a longitudinally extending central ring passage 48 having a first ring diameter 52 formed by an annular lower ring wall portion 50, a second, larger ring diameter 54 formed by an annular upper ring wall portion 56, and a step or transition portion 58 positioned between lower ring wall portion 50 and upper ring wall portion 56. Upper ring wall portion 56 has a longitudinal length 72. In the exemplary embodiment, sealing ring 12 is formed of a single unitary piece. While sealing ring 12 may be formed of multiple pieces, a single piece is easier to form and assemble as opposed to two or more pieces. In an exemplary embodiment, sealing ring 12 is formed of a stainless steel material, which may be an SAE 303 stainless steel. In addition to the other benefits provided by sealing ring 12, the material of sealing ring 12 provides a thermal barrier to the combustion heat from combustion chamber 46.

Sealing ring 12 includes ring proximate end surface 76 and a sealing ring angled surface 82. As described hereinabove, proximate end surface 76 is sized and dimensioned to form a fluid seal with fuel injector body 28. In an exemplary embodiment, proximate end surface 76 is a flat, planar surface that abuts or contacts a distal end of housing retainer 36, which has a flat, planar injector body surface 86 that mates with proximate end surface 76.

Heat transfer sleeve 14 is sized, dimensioned, and formed of an appropriate material to yield when forced into an interference fit with another component, such as nozzle element housing 32 or sealing ring 12. Heat transfer sleeve 14 is a component that is fabricated distinctly or formed separately from sealing ring 12 of a material that is different from the material of sealing ring 12. The purpose of the two different materials is to beneficially combine a material having sufficient a structural or load bearing strength to receive the significant clamp loads required to secure fuel injector 22 in cylinder head 18 with an enhanced thermal conductivity to transport, transfer, or wick heat from a distal end of nozzle element housing 32 toward an upper portion of fuel injector 22 that is cooler than the distal end of nozzle element housing 32. The benefit to this heat transfer is that it reduces the temperature in the distal end of nozzle element housing 32, reducing nozzle tip temperatures and reducing the degradation of fuel, which can cause deposits on nozzle element housing 32. These deposits can contribute to erratic spray patters from fuel injector 22 as well as drift in the quantity of fuel injected. Heat transfer sleeve 14 includes a distal end 62, a proximate end or head portion 64, and a longitudinally extending portion 66 that connects distal end 62 to proximate end 64 to position proximate end 64 a spaced longitudinal distance from distal end 62. In the exemplary embodiment, heat transfer sleeve 14 is formed of a single unitary piece. While heat transfer sleeve 14 may be formed of multiple pieces, a single piece is easier to form and assemble as opposed to two or more pieces.

Distal end 62 has an inner surface 63 at a distal end diameter 68 that is smaller than the nozzle housing diameter. During assembly of fuel injector 22, when heat transfer sleeve 14 is positioned on nozzle element housing 32, inner surface 63 is adjacent to, mates with, abuts, or faces the peripheral outer surface of nozzle element housing 32 and heat transfer sleeve 14 achieves an interference fit with nozzle element housing 32 because distal end diameter 68 is smaller than the nozzle housing diameter. Furthermore, because heat transfer sleeve 14 is fabricated from a material that is softer or weaker than the material of nozzle element housing 32, heat transfer sleeve 14 yields or flexes during assembly rather than causing significant distortion or yielding of nozzle element housing 32. In the exemplary embodiment, heat transfer sleeve 14 is formed of a copper material, which in the exemplary embodiment is either UNS C15100 or UNS C15000 and includes an H01 temper. It should be understood that other materials having suitable thermal conductivity and suitable yield strength may also be used.

Proximate end 64 includes an exterior proximate end diameter that is larger than first ring diameter 52 and may be larger than second ring diameter 54. Proximate end 64 further includes an annular peripheral or outer surface 70. If the exterior proximate end diameter of proximate end 64 is larger than second ring diameter 54, then when heat transfer sleeve 14 is inserted into sealing ring 12 from a proximate end of sealing ring 12, peripheral surface 70 is adjacent to, faces, abuts, or mates with upper ring wall portion 56 and forms an interference or press fit with upper ring wall portion 56. Proximate end 64 includes a longitudinal length that is less than longitudinal length 72 of upper ring wall portion 56 so that when heat transfer sleeve 14 is inserted into sealing ring 12 and injector seal assembly 10 is positioned between fuel injector 22 and cylinder head 18, heat transfer sleeve 14 is able to move longitudinally because of a gap 74 that may be positioned longitudinally between injector body 28 and the proximate end of heat transfer sleeve 14, or may be positioned longitudinally between a distal end of proximate end 64 and step or transition portion 58, or gap 74 may be in both locations. The purpose of gap 74 is to prevent the significant clamp loads transmitted from injector body 28 through sealing ring 12 into cylinder head 18 from being transmitted through heat transfer sleeve 14. It should also be apparent from the description of proximate end 64 and length 72 that head portion 64 is captured between injector body 28 and step portion 58.

Longitudinally extending portion 66 connects distal end 62 with proximate end 64. Longitudinally extending portion 66 is a spaced radial distance from engine body 19, e.g., cylinder head 18, and a spaced radial distance from fuel injector 22, e.g., nozzle element housing 32. One purpose for spacing longitudinally extending portion 66 from fuel injector 22 is to reduce the assembly force required to press heat transfer sleeve 14 onto fuel injector 22, which might otherwise cause heat transfer sleeve 14 to distort under the force of assembly or installation. Longitudinally extending portion 66 may have a diameter greater than first ring diameter 52 where the outer surface of longitudinally extending portion 66 is adjacent to, faces, abuts, or mates with lower ring wall portion 50, which would thus cause longitudinally extending portion 66 to be a press or interference fit with lower ring wall portion 50. Heat transfer sleeve 14 may be an interference or press fit with lower ring wall portion 50, with upper ring wall portion 56, or with both lower ring wall portion 50 and upper ring wall portion 56. One benefit to using one component, i.e., sealing ring 12, as a seal and to receive the clamping forces that hold fuel injector 22 into cylinder head 18, and a second component, i.e., heat transfer sleeve 14 in a location extending from a distal end of nozzle element housing 32 to sealing ring 12, is that injector seal assembly 10 achieves the core benefit of combustion sealing combined with a heat transfer function. The heat is received by heat transfer sleeve 14 at the distal end of nozzle element housing 32 and the heat is readily conducted from heat transfer sleeve 14 into sealing ring 12, where the heat may then flow into fuel injector body 28, e.g., housing retainer 36. Another benefit to this contact is that it is easier to assemble sealing ring 12 and separate heat transfer sleeve 14 as an assembly prior to attaching sealing ring 12 and heat transfer sleeve 14 to fuel injector 22 rather than attaching each component to fuel injector 22 individually.

Figure 3:
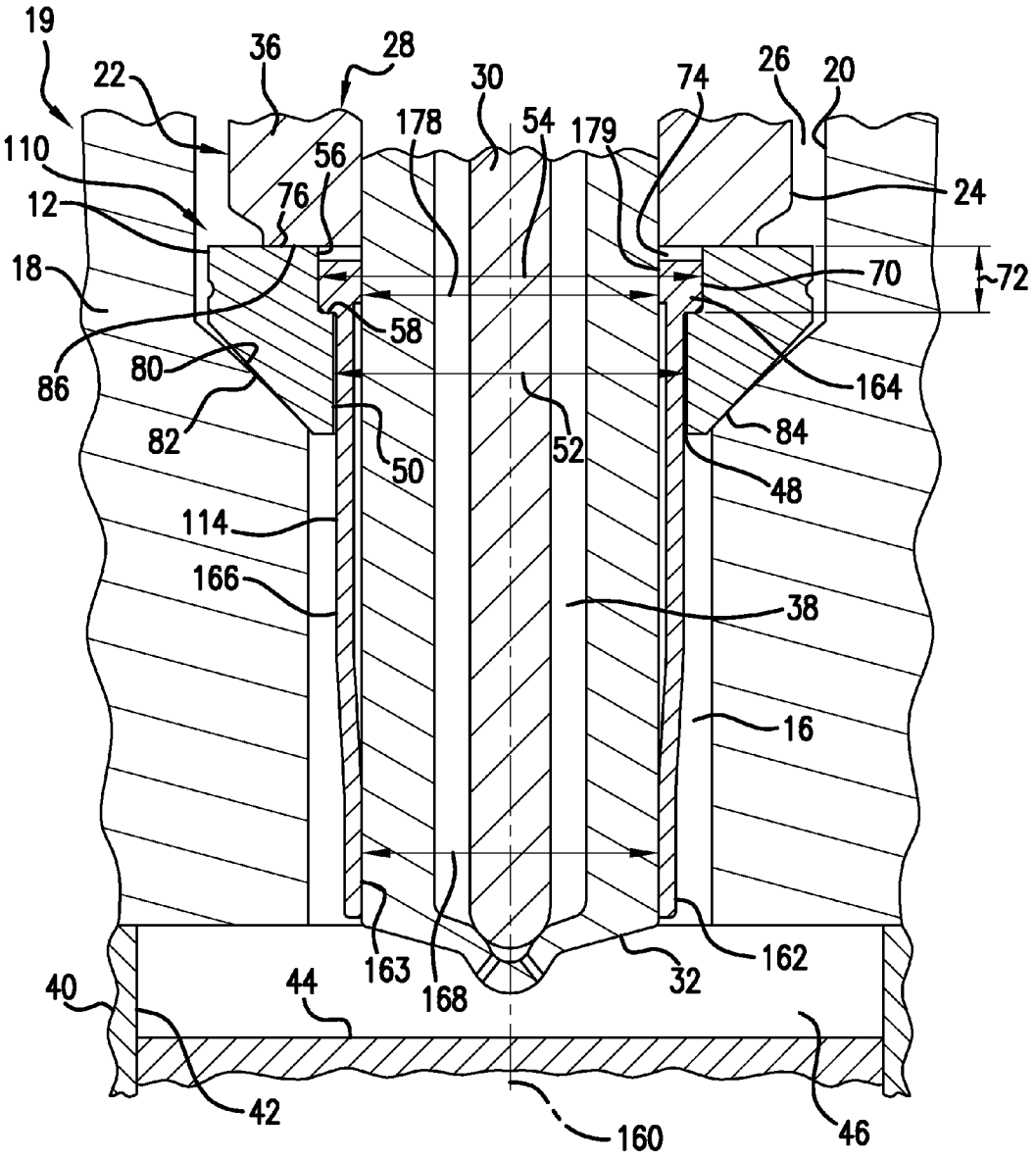
FIG. 3 is a cross-sectional view of an injector seal assembly in accordance with a second exemplary embodiment of the present disclosure inserted into position in an engine mounting bore.

Referring now to FIG. 3, a second exemplary embodiment of the present disclosure is shown. Elements that are the same as the first embodiment are numbered the same as the first embodiment, and are described in this embodiment only for the sake of clarity. A second exemplary embodiment of an injector seal assembly, generally indicated at 110 in FIG. 3, includes seal component, sealing ring, or spacer component 12, and a heat transfer sleeve, heat transfer inner sleeve, or thermally conductive component 114, for positioning in fuel injector mounting bore 16 formed in a portion, e.g., cylinder head 18, of engine body 19 of an internal combustion engine. Cylinder head 18 includes interior surface 20 that forms fuel injector mounting bore 16. The internal combustion engine also includes fuel injector 22, which includes peripheral exterior surface 24, positioned in fuel injector mounting bore 16. Interior surface 20 of fuel injector mounting bore 16 and exterior surface 24 of fuel injector 22 forms annular gap or passage 26 that extends radially between fuel injector 22 and cylinder head 18.

Fuel injector 22 includes a plurality of components, including injector body 28 in which is positioned needle or nozzle valve element 30. Injector body 28 includes nozzle element housing 32 and housing retainer 36 that attaches nozzle element housing 32 to fuel injector 22. Injector body 28 also includes nozzle element cavity 38 in which nozzle valve element 30 is positioned for reciprocal movement along a fuel injector longitudinal axis 160. Nozzle element housing 32 includes a nozzle housing diameter.

Annular gap or passage 26 is simply, easily and reliably sealed from combustion chamber 46 to isolate annular gap or passage 26 from combustion chamber 46 by insertion of injector seal assembly of 110 between fuel injector 22 and a portion of the internal combustion engine, e.g., cylinder head 18. Injector seal assembly 110 provides a metal to metal combustion seal with contact pressures high enough to yield sealing ring 12 into sealing contact against interior surface 20 of injector mounting bore 16, and then maintain that contact pressure with the force from the fuel injector 22 mounting or securement system (not shown). That is, the injector clamping or securing load, for securing fuel injector 22 in mounting bore 16, is relied upon to apply a sealing force to sealing ring 12. In an exemplary embodiment, injector mounting bore 16 includes angled surface 80 and sealing ring 12 includes sealing ring angled surface 82 that contacts bore angled surface 80 when injector seal assembly 110 is positioned in injector mounting bore 16. In an exemplary embodiment, bore angled surface 80 is at a full angle of about 90 degrees, and sealing ring angled surface 82 is at a full angle of about 87.25 degrees. The clamp load that holds fuel injector 22 in injection mounting bore 16 causes annular line of contact 84 between bore angled surface 80 and sealing ring angled surface 82, forming a fluid seal between sealing ring 12 and engine body 19. Sealing ring 12 is configured as previously described.

Heat transfer sleeve 114 is sized, dimensioned, and formed of an appropriate material to yield when forced into an interference fit with another component, such as nozzle element housing 32 or sealing ring 12. Heat transfer sleeve 114 includes a distal end 162, a proximate end 164, and a longitudinally extending portion 166 that connects distal end 162 to proximate end 164.

Distal end 162 has a distal end diameter 168 that is smaller than the nozzle housing diameter and an inner surface 163. During assembly of fuel injector 22, when heat transfer sleeve 114 is positioned on nozzle element housing 32, heat transfer sleeve 114 achieves an interference fit with nozzle element housing 32 because inner surface 163 is adjacent to, mates with, abuts, or faces the peripheral outer surface of nozzle element housing 32 and because distal end diameter 168 is smaller than the nozzle housing diameter. Furthermore, because heat transfer sleeve 114 is formed from a material that is softer or weaker than the material of nozzle element housing 32, heat transfer sleeve 114 yields or flexes during assembly rather than causing significant distortion or yielding of nozzle element housing 32. In the exemplary embodiment, heat transfer sleeve 114 is formed of a copper material, which in the exemplary embodiment is either UNS C15100 or UNS C15000 and includes an H01 temper. It should be understood that other materials having suitable thermal conductivity and suitable yield strength may also be used.

Proximate end 164 includes an exterior proximate end diameter that is larger than first ring diameter 52 and may be larger than second ring diameter 54. Proximate end 164 further includes annular peripheral or outer surface 70. If the exterior proximate end diameter of proximate end 164 is larger than second ring diameter 54, then when heat transfer sleeve 114 is inserted into sealing ring 12, peripheral surface 70 forms an interference or press fit with upper ring wall portion 56. Proximate end 164 includes a longitudinal length that is less than longitudinal length 72 of upper ring wall portion 56 so that when heat transfer sleeve 114 is inserted into sealing ring 12 and injector seal assembly 110 is positioned between fuel injector 22 and cylinder head 18, heat transfer sleeve 114 is able to move longitudinally because of gap 74 that may be positioned longitudinally between injector body 28 and the proximate end of heat transfer sleeve 114, or may be positioned longitudinally between a distal end of proximate end 64 and transition portion 58, or gap 74 may be in both locations. The purpose of gap 74 has been described hereinabove.

Longitudinally extending portion 166 connects distal end 162 with proximate end 164. Longitudinally extending portion 166 is a spaced distance from engine body 19, e.g., cylinder head 18, and a spaced distance from fuel injector 22, e.g., nozzle element housing 32. Longitudinally extending portion 166 may have a diameter greater than first ring diameter 52 where longitudinally extending portion 166 is adjacent to, faces, abuts, or mates with lower ring wall portion 50, which would thus cause longitudinally extending portion 166 to be a press or interference fit with lower ring wall portion 50. Heat transfer sleeve 114 may be an interference or press fit with lower ring wall portion 50, with upper ring wall portion 56, or with both lower ring wall portion 50 and upper ring wall portion 56. One benefit to the contact between heat transfer sleeve 114 and sealing ring 12 is that heat is readily conducted from heat transfer sleeve 114 into sealing ring 12, where the heat may then flow into fuel injector body 28. A benefit to the press fit contact is that it is easier to assemble sealing ring 12 to separate heat transfer sleeve 114 rather than positioning heat transfer sleeve 114 on nozzle element housing 32 and then attaching sealing ring 12 to heat transfer sleeve 114.

Proximate end 164 also includes an interior diameter 178, which in this embodiment is smaller than the outside diameter of nozzle element housing 32, and an annular inner surface 179. The result of this dimension is that inner surface 179 of proximate end 164 of heat transfer sleeve 114 is a press or interference fit with nozzle element housing 32. Thus, heat transfer sleeve 114 is a press or interference fit with nozzle element housing 32 at distal end 162 and at proximate end 164, and a press or interference fit with sealing ring 12, as described in the first embodiment. The choice of locations for interference fits will depend on the need to secure heat transfer sleeve 114 with respect to nozzle element housing 32 and sealing ring 12.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. An internal combustion engine including a fuel injector assembly for mounting in an engine cylinder head, comprising:

an engine cylinder head sealing surface;

a fuel injector body including a longitudinal axis, a nozzle element housing, and a nozzle retainer; and an injector seal assembly positioned between the fuel injector body and the engine cylinder head, the injector seal assembly including a seal component formed of a first material, the seal component positioned in a space formed longitudinally between the fuel injector body and the engine cylinder head sealing surface for receiving a fuel injector clamp load, and a thermally conductive component formed of a second material different than the first material, the second material having a higher thermal conductivity than the first material, and the thermally conductive component positioned radially between the nozzle element housing and the seal component to transfer heat from the nozzle element housing to the seal component, the fuel injector clamp load transmitted to the engine cylinder head sealing surface through the seal component and independent of the thermally conductive component.

2. The internal combustion engine of claim 1, wherein the seal component is positioned longitudinally between the nozzle retainer and the cylinder head.

3. An internal combustion engine, comprising:

a mounting bore having a longitudinal axis formed in a portion of the engine and including a sealing surface formed at a first angle with respect to the longitudinal axis;

a fuel injector positioned in the mounting bore, the fuel injector including an injector body having a nozzle housing;

a sealing ring positioned longitudinally between the injector body and the sealing surface to create a first fluid seal between the sealing ring and the sealing surface;

a heat transfer sleeve formed from a thermally conductive material to transfer heat from the nozzle housing to the sealing ring and including a heat transfer sleeve first end, a heat transfer sleeve second end, a heat transfer sleeve inner surface, and a heat transfer sleeve outer surface, the heat transfer sleeve sized and dimensioned to be positionable in the mounting bore adjacent the nozzle housing, the heat transfer sleeve inner surface dimensioned to exert a radial force inwardly on the nozzle housing at the heat transfer sleeve second end and the heat transfer sleeve outer surface dimensioned to exert a radial force outwardly on the sealing ring at the heat transfer sleeve first end; and a fuel injector clamp load transmitted to the sealing surface through the sealing ring and independent of the heat transfer sleeve.

4. The internal combustion engine of claim 3, wherein the heat transfer sleeve inner surface is dimensioned to exert a radial force inwardly on the nozzle housing at the heat transfer sleeve first end.

5. The internal combustion engine of claim 3, wherein the sealing ring is formed from a first material and the heat transfer sleeve is formed from a second material that is different from the first material.

6. The internal combustion engine of claim 5, wherein the first material is a stainless steel material.

7. The internal combustion engine of claim 6, wherein the stainless steel material is SAE 303.

8. The internal combustion engine of claim 5, wherein the second material is a copper material.

9. The internal combustion engine of claim 8, wherein the copper material is one of the group consisting of UNS C15100 and UNS C15000, including an HO 1 temper.

10. The internal combustion engine of claim 3, wherein the first angle is about 45 degrees.

11. The internal combustion engine of claim 3, wherein the sealing ring includes a second angle for mating with the sealing surface and the second angle is about 43.625 degrees.

12. The internal combustion engine of claim 3, wherein the heat transfer sleeve includes a head portion and the sealing ring includes a step portion and the head portion is captured between the step portion and the injector body.

13. An internal combustion engine comprising:

an engine body including a combustion chamber and a mounting bore;

a fuel injector positioned in the mounting bore and including a longitudinal axis and a distal end;

a spacer component positioned longitudinally between the fuel injector and the engine body at a spaced longitudinal distance from the distal end for receiving a fuel injector clamp load; and a thermally conductive component in contact with the distal end and with the spacer component and positioned a spaced radial distance from the engine body and a spaced radial distance from the fuel injector in a region extending between the distal end and the spacer component, the fuel injector clamp load transmitted to the engine body through the spacer component and independent of the thermally conductive component.

14. The internal combustion engine of claim 13, wherein a proximate end of the thermally conductive component is a press fit radially between the spacer component and an exterior radial surface of the fuel injector.

15. The internal combustion engine of claim 13, wherein the spacer component is formed from a first material and the thermally conductive component is formed from a second material that is different from the first material.

16. The internal combustion engine of claim 15, wherein the first material is a stainless steel material.

17. The internal combustion engine of claim 16, wherein the stainless steel material is SAE 303.

18. The internal combustion engine of claim 15, wherein the second material is a copper material.

19. The internal combustion engine of claim 18, wherein the copper material is one of the group consisting of UNS C15100 and UNS C15000, including an HO 1 temper.

* * * * *